US010501914B2

(12) United States Patent
Lin

(10) Patent No.: US 10,501,914 B2
(45) Date of Patent: Dec. 10, 2019

(54) COUPLING DEVICE AND A FAUCET ASSEMBLY HAVING THE SAME

(71) Applicant: Ming-Shuan Lin, Taichung (TW)

(72) Inventor: Ming-Shuan Lin, Taichung (TW)

( * ) Notice: Subject to any disclaimer, the term of this patent is extended or adjusted under 35 U.S.C. 154(b) by 68 days.

(21) Appl. No.: 15/865,465

(22) Filed: Jan. 9, 2018

(65) Prior Publication Data

US 2018/0320344 A1 Nov. 8, 2018

(30) Foreign Application Priority Data

May 3, 2017 (TW) ..... 106206210 U

(51) Int. Cl.
*E03C 1/04* (2006.01)

(52) U.S. Cl.
CPC ..... *E03C 1/0401* (2013.01); *E03C 1/0403* (2013.01); *E03C 2001/0414* (2013.01); *E03C 2001/0416* (2013.01)

(58) Field of Classification Search
CPC ..... E03C 1/0401; E03C 1/0403; E03C 2001/0414; E03C 2001/0416
USPC ..... 137/801, 625.17
See application file for complete search history.

(56) References Cited

U.S. PATENT DOCUMENTS 4,854,347 A * 8/1989 Knapp ..... F16K 47/026 137/625.4
8,051,507 B2 * 11/2011 Lin ..... E03C 1/04 137/603
8,220,492 B2 * 7/2012 Lin ..... E03C 1/0401 137/315.12
2013/0263933 A1 * 10/2013 Sansum et al. ..... E03C 1/0401 137/15.01

* cited by examiner

*Primary Examiner* — Kevin L Lee
(74) *Attorney, Agent, or Firm* — Burris Law, PLLC

(57) ABSTRACT

A coupling device includes a metal fixing plate adjacent to a faucet body, a plastic connecting plate having a surrounding portion that is connected to the fixing plate, an extending portion that extends from the surrounding portion through the fixing plate, and an engaging portion that is formed with a plurality of engaging grooves adapted to be engaged with engaging portions of a switch base, and a metal reinforcing plate connected to the engaging portion and formed with a plurality of guiding holes being respectively in spatial communication with the engaging grooves. Each guiding holes is adapted for withdrawal of a respective engaging portion of the switch base therethrough from a respective one of the engaging grooves.

6 Claims, 6 Drawing Sheets

COUPLING DEVICE AND A FAUCET ASSEMBLY HAVING THE SAME

CROSS-REFERENCE TO RELATED APPLICATION

This application claims priority of Taiwanese Patent Application No. 106206210, filed on May 3, 2017.

FIELD

The disclosure relates to a coupling device and a faucet assembly having the same.

BACKGROUND

Taiwanese Patent No. 1368001 discloses a conventional faucet device, which includes a faucet body, a switch base, and a coupling member connected to the faucet body. During assembly, the faucet body is first placed adjacent to the switch base to connect the coupling member to coupling hooks of the switch base, and then the faucet body and the coupling member are rotated together to firmly engage the coupling member with the coupling hooks, thereby securing the faucet body on the switch base. The faucet body can be rotated reversely relative to the switch base for maintenance.

However, since the coupling member is made of plastic, and since the coupling member is in contact with the coupling hooks during the abovementioned coupling and decoupling processes of the faucet body, the coupling member may gradually be worn after long-term use, which causes loose engagement between the faucet body and the switch base.

SUMMARY

Therefore, an object of the disclosure is to provide a coupling device that can secure a faucet body onto a switch base and that is durable.

Accordingly, the coupling device is adapted for coupling a faucet body onto a switch base. The faucet body has a connecting portion. The switch base has a plurality of engaging portions. The coupling device includes a fixing plate, a connecting plate, and a reinforcing plate. The fixing plate has a circular fixing plate body made of metal and being adjacent to the connecting portion of the faucet body, and is formed with an extension hole. The connecting plate is made of plastic and has a ring-shaped surrounding portion, an extending portion, and an engaging portion. The surrounding portion is connected to an end of the fixing plate body which is adapted to be opposite to the connecting portion of the faucet body. The extending portion extends from the surrounding portion through the extension hole of the fixing plate. The engaging portion extends from the surrounding portion in a direction opposite to the extending portion, and is formed with a plurality of angularly spaced-apart engaging grooves that are adapted to be respectively engaged with the engaging portions of the switch base. The reinforcing plate has a ring-shaped reinforcing plate body made of metal, connected to the engaging portion, adapted to be adjacent to the switch base, and having a periphery that is formed with a plurality of guiding holes being respectively in spatial communication with the engaging grooves. Each of the guiding holes is adapted for withdrawal of a respective one of the engaging portions of the switch base therethrough from a respective one of the engaging grooves.

Another object of the disclosure is to provide a faucet assembly having the abovementioned coupling device.

Accordingly, the faucet assembly includes a faucet body, a switch base, and a coupling device. The faucet body includes a main unit and an operating unit. The main unit has a housing that has a mounting opening, and a connecting portion that is disposed in the housing and that includes a base wall and two water pipes extending from the base wall toward the mounting opening. The operating unit is connected to the main unit. The switch base includes a seat unit and an inlet unit. The seat unit has a base seat, a plurality of angularly spaced-apart engaging portions mounted to the base seat, and two inlet portions extending through the base seat. The inlet unit is rotatably mounted on the base seat, and has two linking pipes. The coupling device includes a fixing plate, a connecting plate, and a reinforcing plate. The fixing plate has a circular fixing plate body made of metal and being adjacent to the connecting portion of the faucet body, and is formed with an extension hole. The connecting plate is made of plastic and has a ring-shaped surrounding portion, an extending portion, and an engaging portion. The surrounding portion is connected to an end of the fixing plate body that is opposite to the connecting portion of the faucet body. The extending portion extends from the surrounding portion through the extension hole of the fixing plate. The engaging portion extends from the surrounding portion in a direction opposite to the extending portion, and is formed with a plurality of angularly spaced-apart engaging grooves that are respectively engaged with the engaging portions of the switch base. The reinforcing plate has a ring-shaped reinforcing plate body made of metal, connected to the engaging portion, being adjacent to the switch base, sleeved on the linking pipes, and having a periphery that is formed with a plurality of guiding holes being respectively in spatial communication with the engaging grooves. The coupling device is rotatable from a lock position, where each of the engaging portions of the switch base is disposed in an end section of a respective one of the engaging grooves, to an unlock position, where the engaging portions of the switch base are registered respectively with the guiding holes of the reinforcing plate to permit withdrawal of the engaging portions from the engaging grooves, respectively. The linking unit is co-rotatable with the coupling device, such that the linking pipes are respectively aligned with the inlet portions of the seat unit and are respectively aligned with the water pipes when the coupling device is at the lock position, and such that the linking pipes are misaligned with the inlet portions of the seat unit and are misaligned with the water pipes when the coupling device is at the unlock position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
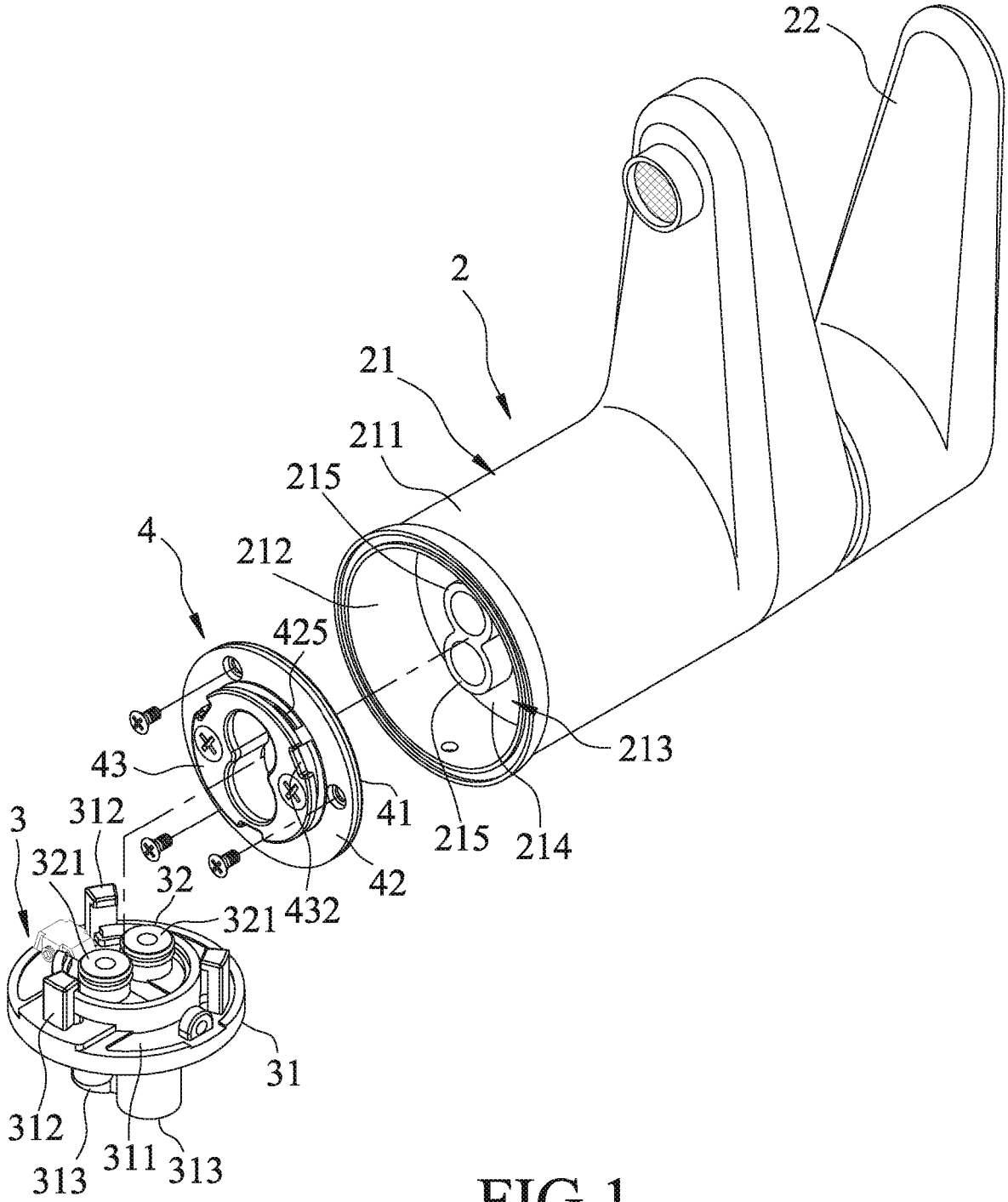
FIG. 1 is a partly exploded perspective view of an embodiment of a faucet assembly according to the disclosure.

Referring to FIG. 1, an embodiment of a faucet assembly according to the present disclosure includes a faucet body 2, a switch base 3, and a coupling device 4.

The faucet body 2 includes a main unit 21 and an operating unit 22 that is connected to the main unit 21. The main unit 21 has a housing 211 that has amounting opening 212, and a connecting portion 213 that is disposed in the housing 211, and that includes a base wall 214 and two water pipes 215 extending from the base wall 214 toward the mounting opening 212.

In this embodiment, the switch base 3 includes a seat unit 31 and an inlet unit 32. The seat unit 31 has a base seat 311 which is adapted to be mounted fixedly on a top surface of a deck (not shown), three angularly spaced-apart engaging portions 312 mounted to the base seat 311, and two inlet portions 313 extending through the base seat 311. The inlet unit 32 is rotatably mounted on the base seat 311 and has two linking pipes 321.

Figure 2:
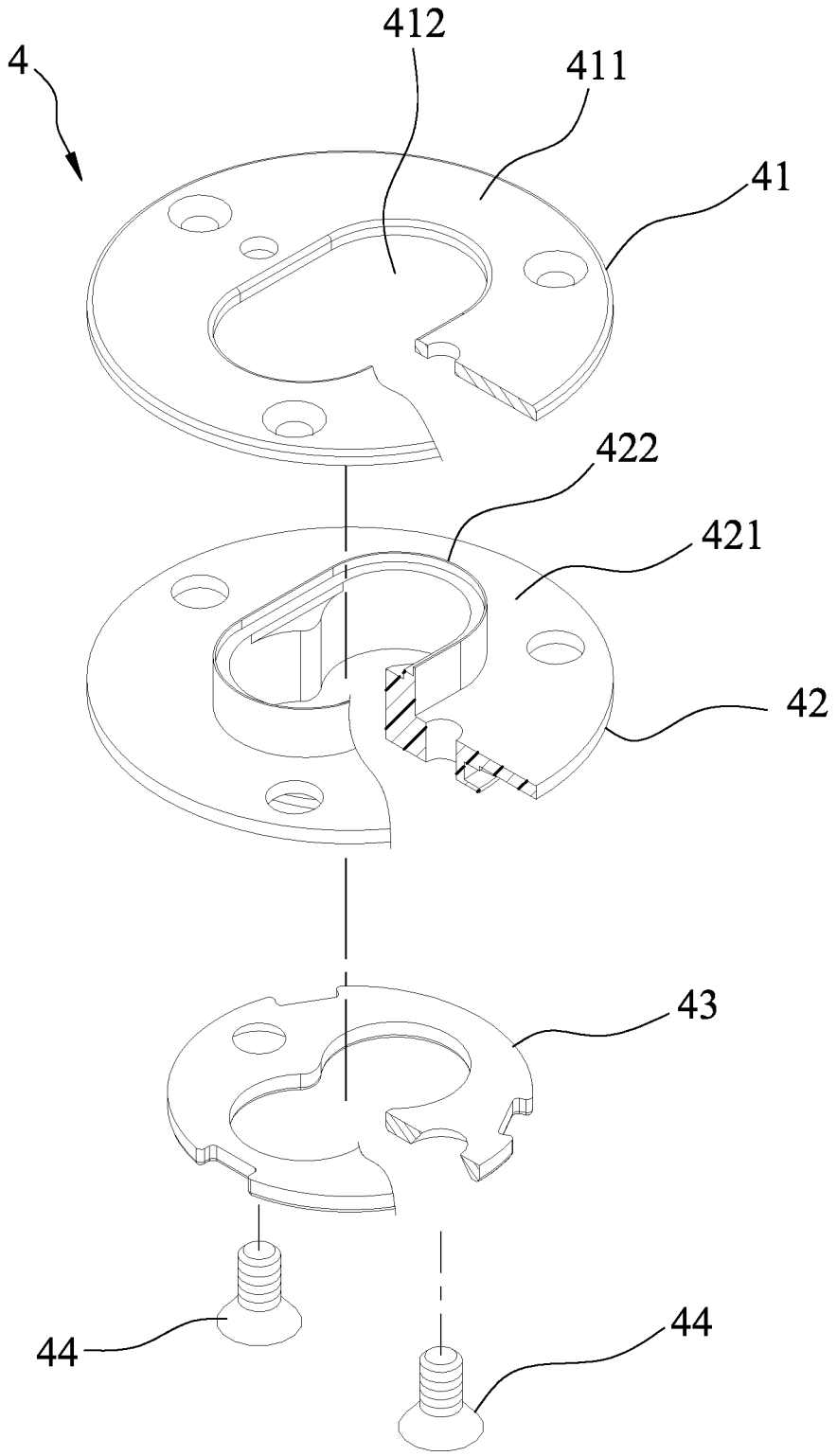
FIG. 2 is an exploded perspective view of a coupling device of the embodiment.
Figure 3:
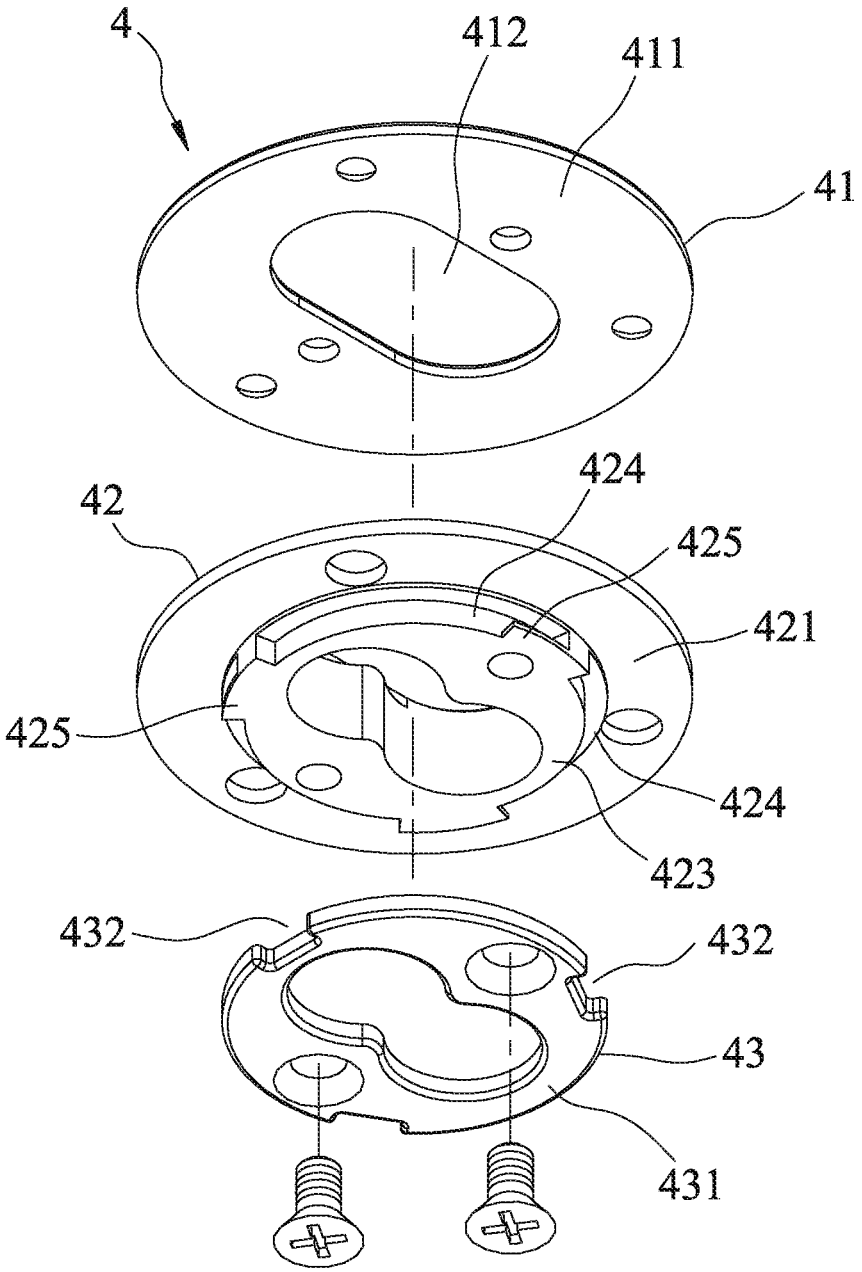
FIG. 3 is another exploded perspective view of the coupling device of the embodiment.
Figure 4:
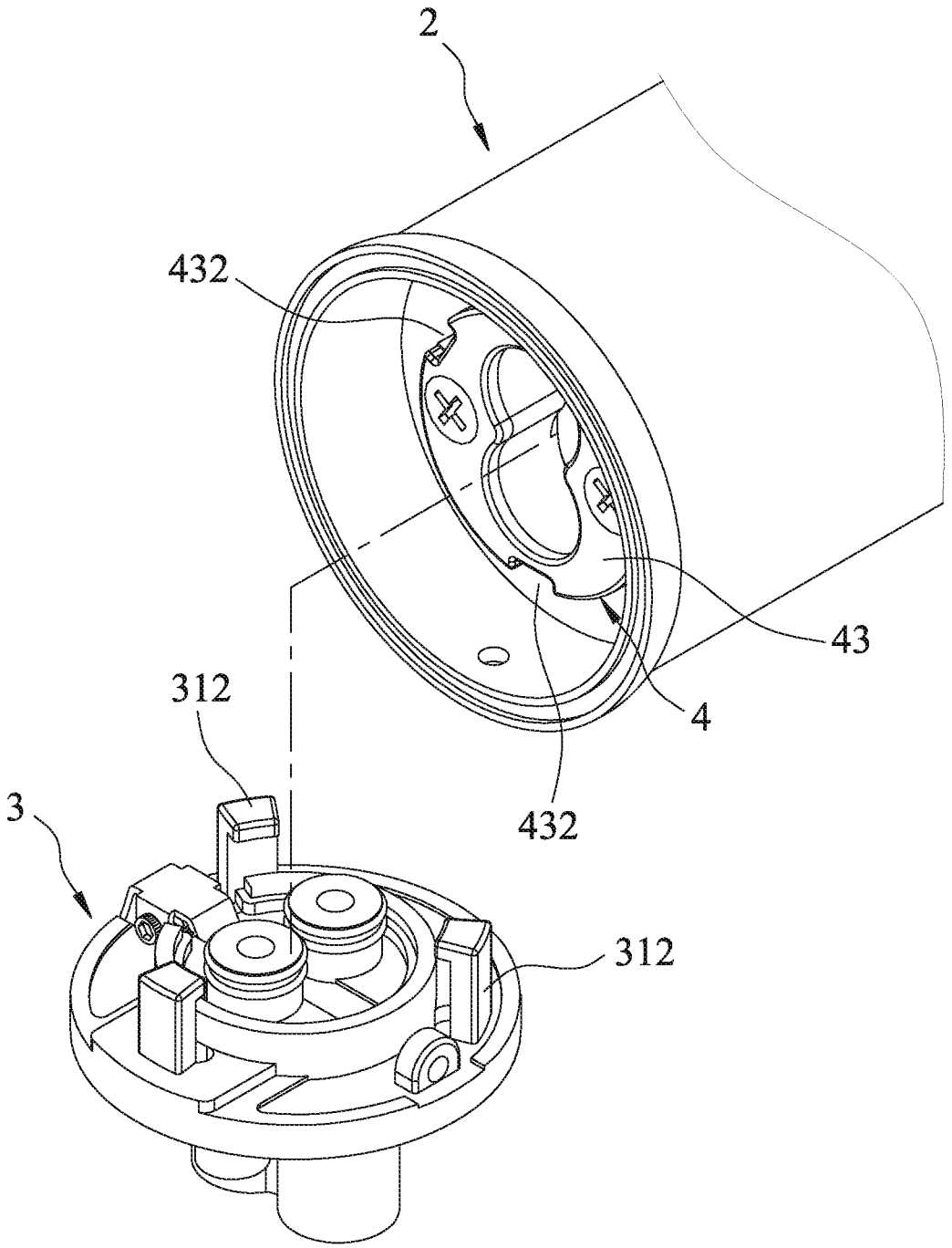
FIG. 4 is a fragmentary partly exploded perspective view of the embodiment.

Referring to FIGS. 1 to 3, the coupling device 4 is disposed for coupling the faucet body 2 onto the switch base 3. In this embodiment, the coupling device 4 includes a fixing plate 41, a connecting plate 42, a reinforcing plate 43, and two threaded components 44. The fixing plate 41 has a circular fixing plate body 411 made of metal and being adjacent to the connecting portion 213 of the faucet body 2, and is formed with an extension hole 412. The connecting plate 42 is made of plastic, and has a ring-shaped surrounding portion 421, an extending portion 422, an engaging portion 423, and three securing blocks 425. The surrounding portion 421 is connected to an end of the fixing plate body 411 that is opposite to the connecting portion 213 of the faucet body 21. The extending portion 422 extends from the surrounding portion 421 through the extension hole 412 of the fixing plate 41. The engaging portion 423 extends from the surrounding portion 421 in a direction opposite to the extending portion 422, and is formed with three angularly spaced-apart engaging grooves 424 that are respectively engaged with the engaging portions 312 of the switch base 3.

The reinforcing plate 43 has a ring-shaped reinforcing plate body 431 made of metal, connected to the engaging portion 423, being adjacent to the switch base 3, sleeved on the linking pipes 321, and having a periphery that is formed with three guiding holes 432 being respectively in spatial communication with the engaging grooves 424. Each of the securing blocks 425 is disposed in an end section of a respective one of the engaging grooves 424 which is opposite to a respective one of the guiding holes 432. The threaded components 44 extend threadedly through the fixing plate 41, the connecting plate 42, and the reinforcing plate 43 for securing the fixing plate 41, the connecting plate 42, and the reinforcing plate 43 together.

Figure 5:
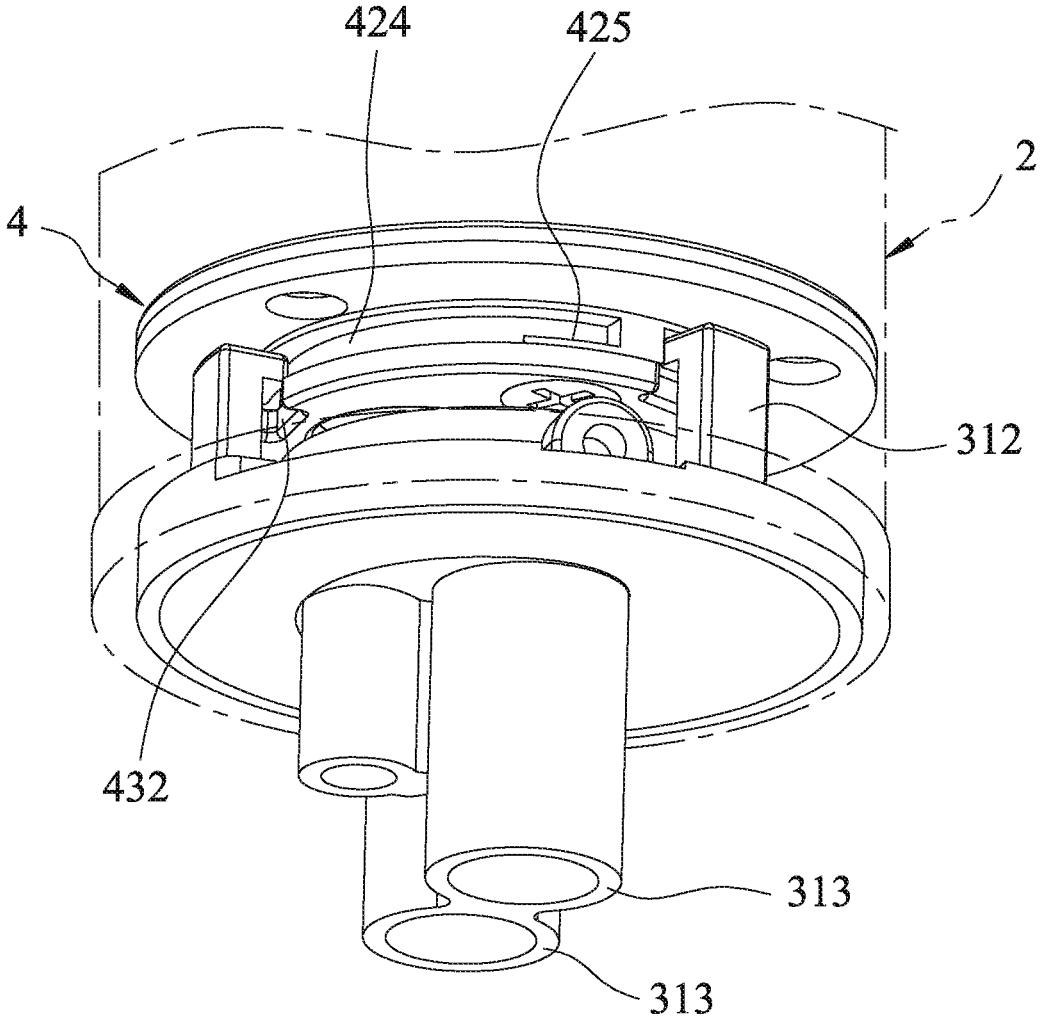
FIG. 5 is a fragmentary assembled perspective view of the embodiment, illustrating the coupling device in an unlock position.
Figure 6:
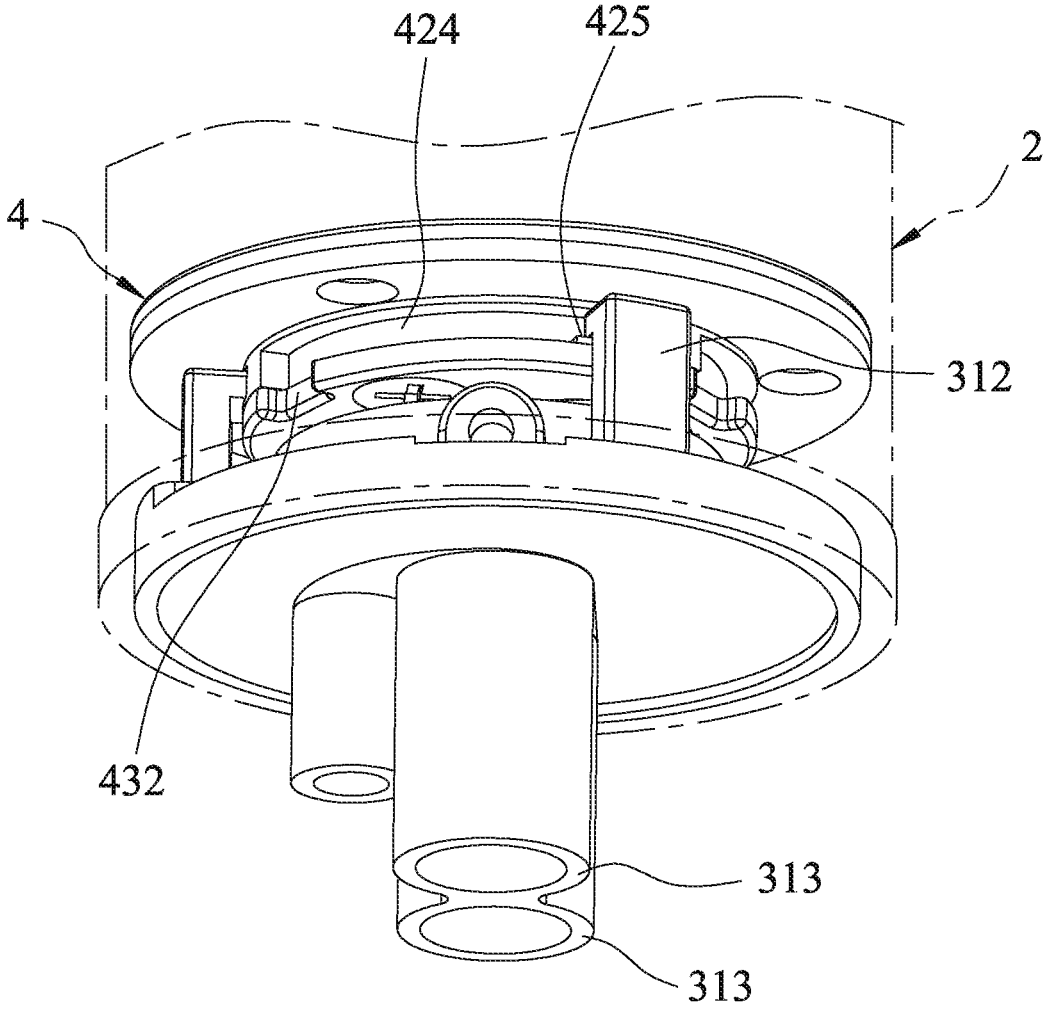
FIG. 6 is a view similar to FIG. 5, but illustrating the coupling device in a lock position.

When coupling the faucet body 2 onto the switch base 3, an operator first needs to fasten the coupling device 4 to the faucet body 2 by disposing the coupling device 4 in an inner space of the housing 211 via the mounting opening 212 and sleeving the coupling device 4 on the water pipes 215. Then, the operator places the faucet body 2 to cover the switch base 3 with the coupling device 4 being in an unlock position (see FIG. 5). At this time, the engaging portions 312 of the seat unit 31 of the switch base 3 extend into the engaging grooves 424 of the coupling device 4 via the guiding holes 432, respectively. Afterwards, the operator rotates the faucet body 2 together with the coupling device 4 relative to the switch base 3 until the coupling device 4 is rotated to a lock position (see FIG. 6), where each of the engaging portions 312 of the switch base 3 travels along the respective one of the engaging grooves 424 to the end section of a respective one of the engaging grooves 424. By the structural design of the securing blocks 425, the securing blocks 425 are respectively in frictional contact with the engaging portions 312 of the switch base 3, thereby securing the coupling device 4 in the lock position. During the rotation of the coupling device 4 from the unlock position to the lock position, the linking unit 32 of the switch base 3 is co-rotatable with the coupling device 4, such that the linking pipes 321 are respectively aligned with the inlet portions 313 of the seat unit 31 and are respectively aligned with the water pipes 215 when the coupling device 4 is in the lock position. In use, the operating unit 22 is operable for spouting out water that flows through the linking pipes 321 and the water pipes 215.

When intending to separate the faucet body 2 from the switch base 3, the operator needs to rotate reversely the coupling device 4 from the lock position to the unlock position, where the engaging portions 312 of the switch base 3 are registered respectively with the guiding holes 432 of the reinforcing plate 43 to permit withdrawal of the engaging portions 312 from the engaging grooves 424, respectively. At this time, the linking pipes 321 are misaligned with the inlet portions 313 of the seat unit 31 and are misaligned with the water pipes 215.

By virtue of the configurations of the fixing plate 41 and the reinforcing plate 43 being made of metal, the coupling device 4 has enhanced structural strength and rigidity, such that the coupling device 4 would not be easily worn after long-term use, and by virtue of the configuration of the connecting plate 42 being made of plastic that is flexible, the coupling device 4 has enhanced durability.

In addition, since the securing blocks 425 are made of plastic, friction between the engaging portions 312 of the switch base 3 and the securing blocks 425 can ensure that the faucet body 2 is firmly secured onto the switch base 3 when the coupling device 4 is in the lock position.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A coupling device adapted for coupling a faucet body onto a switch base, the faucet body having a connecting portion, the switch base having a plurality of engaging portions, said coupling device comprising:

a fixing plate that has a circular fixing plate body made of metal and being adjacent to the connecting portion of the faucet body, and that is formed with an extension hole;

a connecting plate that is made of plastic, and that has a ring-shaped surrounding portion connected to an end of said fixing plate body that is adapted to be opposite to the connecting portion of the faucet body, an extending portion extending from said surrounding portion through said extension hole of said fixing plate, and an engaging portion extending from said surrounding portion in a direction opposite to said extending portion, and formed with a plurality of angularly spaced-apart engaging grooves that are adapted to be respectively engaged with the engaging portions of the switch base; and a reinforcing plate that has a ring-shaped reinforcing plate body made of metal, connected to said engaging portion of said connecting plate, adapted to be adjacent to the switch base, and having a periphery that is formed with a plurality of guiding holes being respectively in spatial communication with said engaging grooves, each of said guiding holes being adapted for withdrawal of a respective one of the engaging portions of the switch base therethrough from a respective one of said engaging grooves.

2. The coupling device as claimed in claim 1, further comprising a plurality of threaded components extending threadedly through said fixing plate, said connecting plate, and said reinforcing plate.

3. The coupling device as claimed in claim 1, wherein:

said connecting plate further has a plurality of securing blocks, each of said securing blocks being disposed in an end section of a respective one of said engaging grooves which is opposite to a respective one of said guiding holes;

said coupling device is rotatable from a lock position, where each of the engaging portions of the switch base is disposed in said end section of a respective one of said engaging grooves, to an unlock position, where the engaging portions of the switch base are registered respectively with said guiding holes of said reinforcing plate to permit the withdrawal of the engaging portions from said engaging grooves, respectively; and when said coupling device is at the lock position, said securing blocks are adapted to be respectively in contact with the engaging portions of the switch base, thereby securing said coupling device at the lock position.

4. A faucet assembly comprising:

a faucet body including a main unit that has a housing having a mounting opening, and a connecting portion disposed in said housing, and including a base wall and two water pipes that extend from said base wall toward said mounting opening; and an operating unit connected to said main unit;

a switch base including a seat unit that has a base seat, a plurality of angularly spaced-apart engaging portions mounted to said base seat, and two inlet portions extending through said base seat, and an inlet unit that is rotatable mounted on said base sea, and that has two linking pipes; and a coupling device including a fixing plate that has a circular fixing plate body made of metal and being adjacent to said connecting portion of said faucet body, and that is formed with an extension hole, a connecting plate that is made of plastic, and that has a ring-shaped surrounding portion connected to an end of said fixing plate body that is opposite to said connecting portion of said faucet body, an extending portion extending from said surrounding portion through said extension hole of said fixing plate, and an engaging portion extending from said surrounding portion in a direction opposite to said extending portion, and formed with a plurality of angularly spaced-apart engaging grooves that are respectively engaged with said engaging portions of said switch base, and a reinforcing plate that has a ring-shaped reinforcing plate body made of metal, connected to said engaging portion, being adjacent to said switch base, sleeved on said linking pipes, and having a periphery that is formed with a plurality of guiding holes being respectively in spatial communication with said engaging grooves;

wherein said coupling device is rotatable from a lock position, where each of said engaging portions of said switch base is disposed in an end section of a respective one of said engaging grooves, to an unlock position, where said engaging portions of said switch base are registered respectively with said guiding holes of said reinforcing plate to permit withdrawal of said engaging portions from said engaging grooves, respectively; and wherein said linking unit is co-rotatable with said coupling device, such that said linking pipes are respectively aligned with said inlet portions of said seat unit and are respectively aligned with said water pipes when said coupling device is at the lock position, and such that said linking pipes are misaligned with said inlet portions of said seat unit and are misaligned with said water pipes when said coupling device is at the unlock position.

5. The faucet assembly as claimed in claim 4, wherein said coupling device further includes a plurality of threaded components extending threadedly through said fixing plate, said connecting plate, and said reinforcing plate.

6. The faucet assembly as claimed in claim 4, wherein:

said connecting plate further has a plurality of securing blocks, each of said securing blocks being disposed in said end section of a respective one of said engaging grooves which is opposite to a respective one of said guiding holes; and when said coupling device is at the lock position, said securing blocks are respectively in contact with said engaging portions of said switch base, thereby securing said coupling device at the lock position.

* * * * *